US005644677A

United States Patent [19]

Park et al.

[11] Patent Number: 5,644,677

[45] Date of Patent: Jul. 1, 1997

[54] SIGNAL PROCESSING SYSTEM FOR PERFORMING REAL-TIME PITCH SHIFTING AND METHOD THEREFOR

[75] Inventors: Sangil Park; Dion M. Funderburk, both of Austin, Tex.

[73] Assignee: Motorola, Inc., Schaumburg, Ill.

[21] Appl. No.: 120,266

[22] Filed: Sep. 13, 1993

[51] Int. Cl.[6] ..... G10L 5/00

[52] U.S. Cl. ..... 395/2.16; 395/2.2; 395/2.33; 395/2.74

[58] Field of Search ..... 395/2.14, 2.16, 395/2.18, 2.74, 2.77

[56] References Cited

U.S. PATENT DOCUMENTS

| | | | |
|---|---|---|---|
| 3,816,664 | 6/1974 | Koch | 395/2.77 |
| 4,700,391 | 10/1987 | Leslie, Jr. et al. | 395/2.16 |
| 5,131,042 | 7/1992 | Oda | 395/2.94 |
| 5,369,725 | 11/1994 | Iizuka et al. | 395/2.16 |

OTHER PUBLICATIONS

Sangil Park; "A Real-Time Method for Sample-Rate Conversion from CD to DAT"; Proc. IEEE Int. Conf. Consumer Electronics, pp. 360–361, Chicago, IL, Jun. 18–20 (1990).

Sangil Park; "Digital Sample-Rate Converters"; Internat'l Congress and Exposition, pp. 1–11, Detroit, Michigan, Feb. 25–Mar. 1 (1991).

Sangil Park; "Real-Time Pitch (Frequency) Shifting Techniques"; Proc. of the 10th Internat'l Conf. on Consumer Electronics, pp. 296–297, Chicago, IL, Jun. 5–7 (1991).

*Primary Examiner*—Ayaz R. Sheikh
*Assistant Examiner*—Tálivaldis Ivars Šmits
*Attorney, Agent, or Firm*—Paul J. Polansky

[57] ABSTRACT

A signal processing system (50) performs real-time pitch shifting for applications such as karaoke, tapeless answering machines, and the like while minimizing distortion. A digital input signal is sampled and stored at successive locations in a variable-size buffer (62) at an input sample rate. Data from the variable-size buffer (62) is interpolated according to a pitch-shifting ratio. An adaptive pitch estimator (61) continually estimates the fundamental frequency of the digital input signal, and the signal processing system (50) adjusts the buffer size of the variable-size buffer (62) in response thereto. The signal processing system (50) changes the buffer size to store the digital input signal for an integral number of periods of the estimated fundamental frequency.

16 Claims, 5 Drawing Sheets

-PRIOR ART-

-PRIOR ART-

-PRIOR ART-

-PRIOR ART-

SIGNAL PROCESSING SYSTEM FOR PERFORMING REAL-TIME PITCH SHIFTING AND METHOD THEREFOR

CROSS-REFERENCE TO RELATED, COPENDING APPLICATION

Related subject matter is disclosed in our copending U.S. patent application Ser. No. 07/797,563, entitled "DTMF Detection Having Sample Rate Decimation and Adaptive Tone Detection," filed Nov. 25, 1991, now U.S. Pat. No. 5,392,348, issued Feb. 21, 1995 and assigned to the assignee hereof.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

This invention relates generally to signal processing systems, and more particularly, to signal processing systems performing pitch shifting.

BACKGROUND OF THE INVENTION

Pitch shifting is a technique used to harmonically transpose a sampled audio signal without altering either its time duration or relative frequency content. Pitch shifting is important to a number of broadcasting and recording applications, such as karaoke and tapeless answering machines.

For analog systems such as vinyl records, pitch shifting is straightforward, and can be accomplished by increasing or decreasing a record's rotation speed from the standard number of revolutions per minute (RPM), such as from 33 RPM to 45 RPM. However, this analog technique alters both time duration and tempo, and thus does not result in the desired pitch-shifting characteristics.

Digital systems may also perform pitch shifting, but known digital systems also fail to provide ideal pitch-shifting characteristics. One digital technique which may be used in pitch shifting is known as the direct technique. According to the direct technique, a digital signal is sampled at a first rate, stored in a circular buffer at a second, different rate, and output from the buffer at the first rate. The ratio between the first and second rates determines the amount of pitch shifting. The problem with this technique is that the output signal will be "jumpy", i.e., occasionally discontinuous due to a lack of smoothing of the output signal.

Another digital technique which may be used for real-time pitch shifting is the sample-rate conversion technique disclosed by S. Park, "A Real-Time Method for Sample-Rate Conversion from CD to DAT," *Proceedings of the 9th Int. Conf. on Consumer Electronics,* Chicago, Ill., Jun. 18–20, 1990, pp. 360–361. This technique uses the same circular buffer as the direct technique to maintain real-time operation. The sample-rate conversion technique computes the pitch-shifted output sample as an interpolated value between two input samples using digital filtering. While this method eliminates the discontinuities associated with the direct technique and provides good performance in some applications, it still introduces harmonic distortion. Since the data must be processed in real-time, there will periodically be overrun and underrun states between the input and output pointers. For example, if the pitch is to be lowered, the input pointer cycles through the buffer more quickly than the output pointer. If the input pointer "passes" the output pointer and at the same time overwrites data from a different point in its waveform, the next output sample will be discontinuous. These discontinuities in the output waveform result in undesirable non-harmonic distortion. What is needed is a signal processing system for real-time pitch shifting which provides an output signal with lower distortion than that provided by known digital techniques.

SUMMARY OF THE INVENTION

Accordingly, the present invention provides, in one form, a signal processing system for performing real-time pitch shifting including an adaptive pitch estimator, a variable-size buffer, and an interpolator. The adaptive pitch estimator has an input terminal for receiving a digital input signal, a sampling rate input terminal for receiving a sample clock signal, and an output terminal for providing a buffer size signal. The adaptive pitch estimator provides the buffer size signal equal to an integer multiple of, a period of a fundamental frequency of the digital input signal divided by a period of the sample clock signal. The variable-size buffer has a data input terminal for receiving the digital input signal, a size input terminal coupled to the output terminal of the adaptive pitch estimator for receiving the buffer size signal, and an output terminal. The interpolator has a data input terminal coupled to the output terminal of the variable-size buffer, and an output terminal for providing a pitch-shifted digital output signal.

In another embodiment, the present invention provides a method for performing real-time pitch shifting. A digital input signal is received at a sample clock rate. The digital input signal is stored at successive locations of a variable-size buffer. The variable-size buffer has a variable size associated therewith. A fundamental frequency of the digital signal is adaptively estimated to provide an estimated fundamental frequency. The variable size of the variable-size buffer is changed in response to the estimated fundamental frequency. The digital input signal stored in the variable-size buffer is interpolated to provide a digital pitch-shifted output signal.

These and other features and advantages will be more clearly understood from the following detailed description taken in conjunction with the accompanying drawings.

DETAILED DESCRIPTION OF A PREFERRED EMBODIMENT

Figure 1:
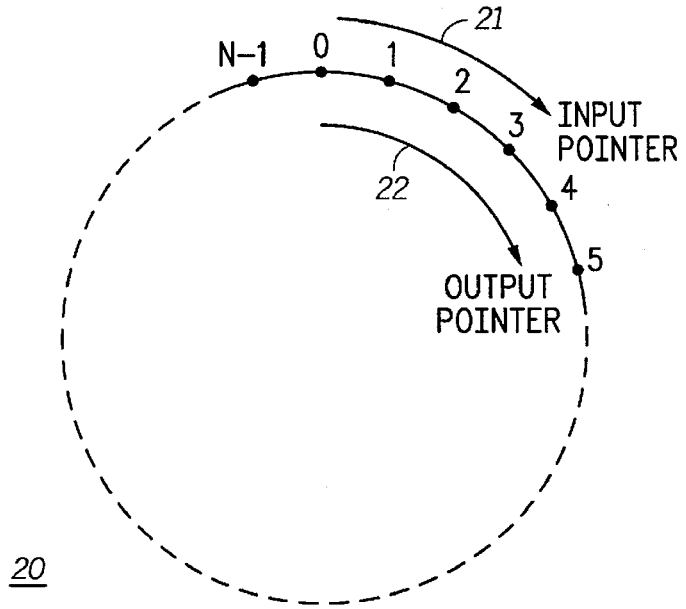
FIG. 1 illustrates a conceptual diagram of a buffer system for use with a direct technique pitch shifter known in the prior art.

FIG. 1 illustrates a conceptual diagram of a buffer system 20 for use with a direct technique pitch shifter known in the prior art. Buffer system 20 is illustrated as a circle with N points on the circle, each represented by a dot. Each point corresponds to an entry in buffer 20. A first arrow 21 labelled "INPUT POINTER" operates at a sampling frequency labelled "$f_S$" to store data samples in buffer system 20. A second arrow 22 labelled "OUTPUT POINTER" operates at sampling frequency $f_S$ to retrieve samples from buffer 20. OUTPUT POINTER 22, which locates the data to be sent out, is defined as:

$$\text{OUTPUT POINTER}=\text{Int}(\text{INPUT POINTER}\cdot\rho) \quad [1]$$

where Int () represents the integer operation, and $\rho=\rho_O/\rho_I$ is the pitch-shifting ratio, defined as the ratio of the output pitch $P_O$ to the input pitch $P_I$.

Figure 2:
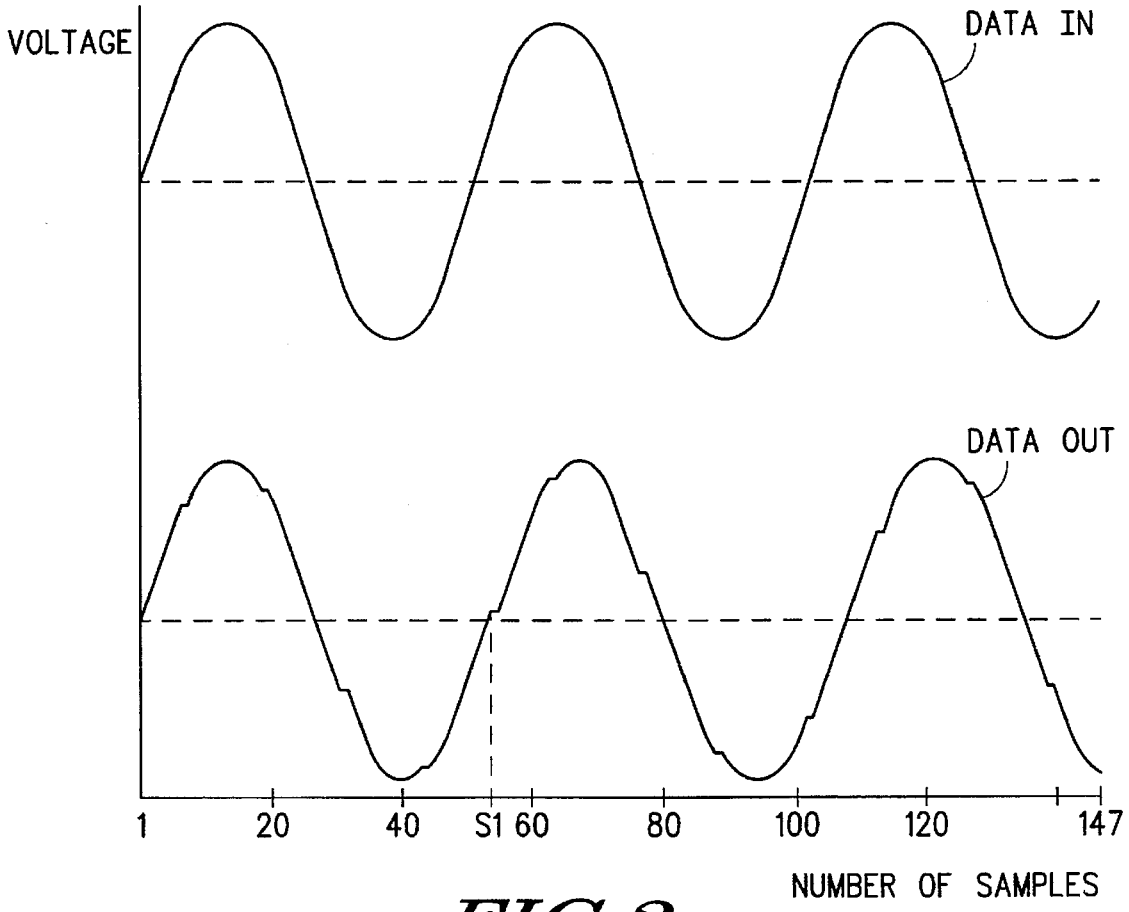
FIG. 2 illustrates a timing diagram of a digital signal illustrating deficiencies of the pitch shifter using the buffer system of FIG. 1.

Assume both INPUT POINTER 21 and OUTPUT POINTER 22 start at point 0. For $f_{S2}<f_{S1}$, OUTPUT POINTER 22 will eventually move ahead of INPUT POINTER 21 by a full sample, resulting in a discontinuity in the output data samples, which causes non-harmonic distortion. This discontinuity is better understood with reference to FIG. 2, which illustrates a timing diagram of a digital signal illustrating deficiencies of the pitch shifter using buffer system 20 of FIG. 1. FIG. 2 illustrates the number of samples along the horizontal axis, and the signal voltage along the vertical axis. A sampled input signal labelled "DATA IN" is illustrated as a sinusoidal signal of a given frequency (pitch) which is to be pitch-shifted. A sampled output signal labelled "DATA OUT" is an approximately sinusoidal signal with a slightly lower pitch than DATA IN. DATA OUT is not perfectly sinusoidal because periodically, a sample is repeated. For example, at a sample point labelled "S1", a sample value is repeated for one sample period. This occurs because DATA OUT has a slightly lower pitch than the pitch of DATA IN. This discontinuity adds non-harmonic distortion to DATA OUT.

Figure 3:
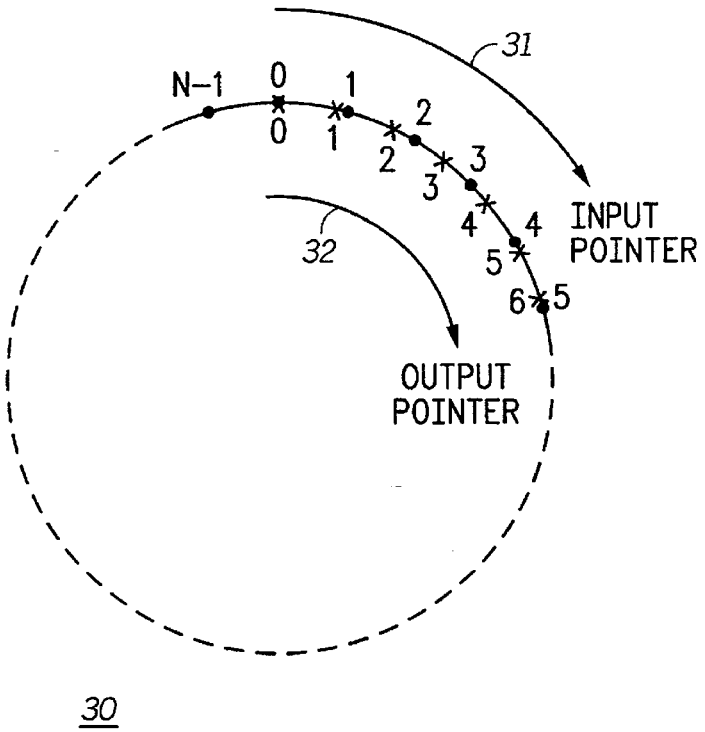
FIG. 3 illustrates a conceptual diagram of a buffer system for use with a sample-rate conversion technique pitch shifter known in the prior art.
Figure 4:
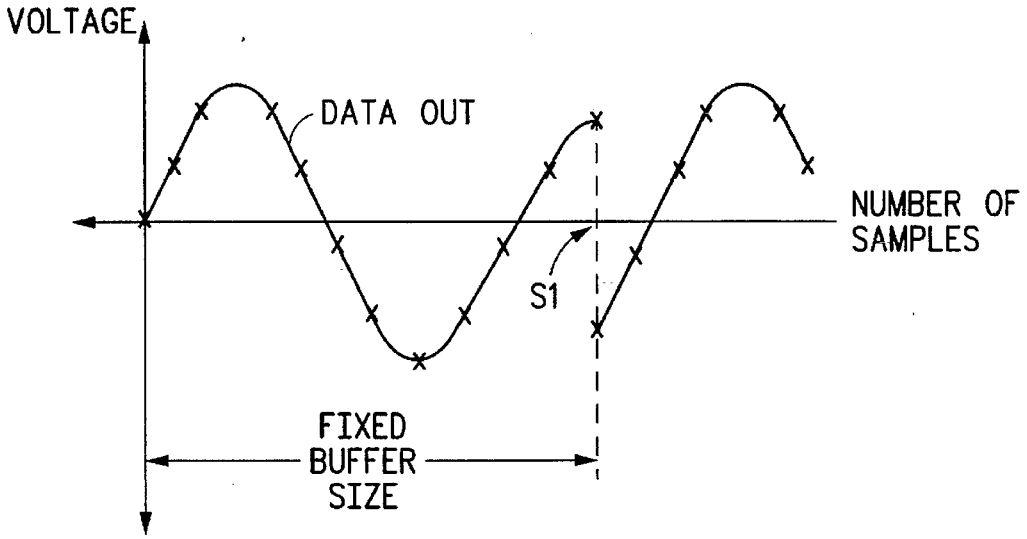
FIG. 4 illustrates a timing diagram of a digital signal illustrating deficiencies of the pitch shifter using the buffer system of FIG. 3.

FIG. 3 illustrates a conceptual diagram of a buffer system 30 for use with a sample-rate conversion technique pitch shifter known in the prior art. This technique recovers fractionally sampled data by interpolating adjacent data values. Buffer system 30 is again illustrated as a circle. Each of N input samples, which corresponds to a location in buffer system 30, is represented by a dot. Each output sample is represented by an "x", which in general is an interpolated value between two input samples. A first arrow 31 corresponding to the INPUT POINTER operates at a sampling frequency of $f_S$ to store data samples in buffer system 30. A second arrow 32 corresponding to the OUTPUT POINTER operates at the same sampling frequency to provide output samples interpolated from two input samples using digital filtering techniques. Assume both INPUT POINTER 31 and OUTPUT POINTER 32 start at point 0. While INPUT POINTER 31 or OUTPUT POINTER 32 will become unsynchronized as before, interpolation of the output samples prevents the dropping or repeating of samples associated with the direct technique. However, the sample-rate conversion pitch shifter based on buffer 30 suffers from another source of discontinuity, which is better illustrated in FIG. 4, which illustrates a timing diagram of a digital signal illustrating deficiencies of the pitch shifter using buffer system 30 of FIG. 3. FIG. 4 illustrates the number of samples along the horizontal axis, and the signal voltage along the vertical axis. Note that FIG. 4 exaggerates the horizontal scale by minimizing the number of samples per cycle to illustrate a discontinuity caused by the sample-rate converter-type pitch shifter. Interpolated output signal DATA OUT is illustrated as an approximately sinusoidal signal. Each sample period is represented by an "x" on a continuous waveform. Due to the different scan speed between the input pointer and the output pointer, DATA IN will eventually overrun DATA OUT. At a sample point labelled "S1", DATA IN overruns DATA OUT, causing a discontinuity in DATA OUT. This discontinuity results in non-harmonic distortion.

Figure 5:
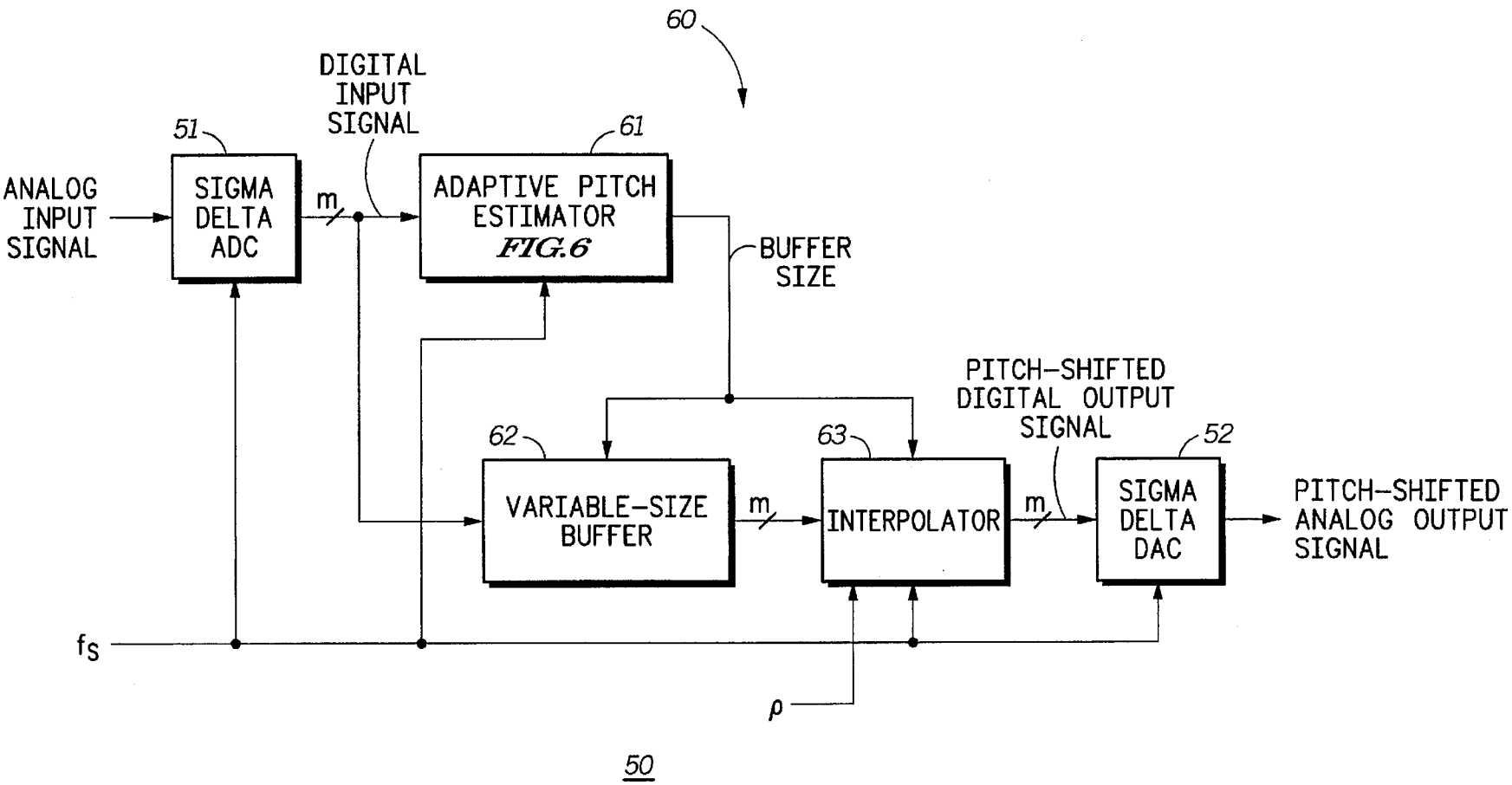
FIG. 5 illustrates in block diagram form a signal processing system for performing real-time pitch shifting in accordance with the present invention.

FIG. 5 illustrates in block diagram form a signal processing system 50 for performing real-time pitch shifting in accordance with the present invention. Signal processing system 50 includes an optional sigma-delta analog-to-digital converter (ADC) 51, an optional sigma-delta digital-to-analog converter (DAC) 52, and an adaptive pitch shifter 60. ADC 51 receives a signal labelled "ANALOG INPUT SIGNAL" and provides an m-bit digital code at a rate of $f_S$ in response thereto. DAC 52 receives an m-bit signal labelled "DIGITAL PITCH-SHIFTED OUTPUT SIGNAL" and provides an analog output signal labelled "ANALOG OUTPUT SIGNAL" in response. ADC 51 and DAC 52 may be used to pitch-shift an analog input signal and to provide an analog output signal, but are not be required to pitch-shift an existing digital signal. Sigma-delta ADCs and DACs are well-known in the art and thus will not be further discussed.

Pitch shifter 60 includes an adaptive pitch estimator 61, a variable-size data buffer 62, an interpolator 63. Adaptive pitch estimator 61 has an input for receiving an m-bit output of ADC 51 labelled "DIGITAL INPUT SIGNAL", a sampling rate input for receiving signal $f_S$, and an output for providing a signal labelled "BUFFER SIZE". Variable-size buffer 62 has an input for receiving the DIGITAL INPUT SIGNAL, a control input for receiving the BUFFER SIZE, and an m-bit output. Interpolator 63 has a data input connected to the output of variable-size buffer 62, a control input for receiving BUFFER SIZE, a sampling rate input for receiving signal $f_S$, a pitch-shifting input for receiving pitch shifting ratio $\rho$, and an output for providing an m-bit signal labelled PITCH-SHIFTED DIGITAL OUTPUT SIGNAL to an input of DAC 52.

Adaptive pitch estimator 61 continually estimates a fundamental frequency of the DIGITAL INPUT SIGNAL to provide BUFFER SIZE to variable-size buffer 62 and interpolator 63. Adaptive pitch estimator 61 alters BUFFER SIZE to be harmonically related to DIGITAL INPUT SIGNAL, that is to be equal to an integer multiple of periods at sample rate $f_S$ of the fundamental frequency in DIGITAL INPUT SIGNAL. In this context, the fundamental frequency is equal to the frequency component with the greatest amplitude. In the illustrated embodiment, the integral number is equal to one, but may be a higher integer in other embodiments. FIGS. 2 and 4 illustrated a perfectly sinusoidal input signal; in the general case, however, DIGITAL INPUT SIGNAL will include a spectrum of tones. Thus, signal processing system 50 adjusts to the most significant tone, the fundamental frequency.

Figure 6:
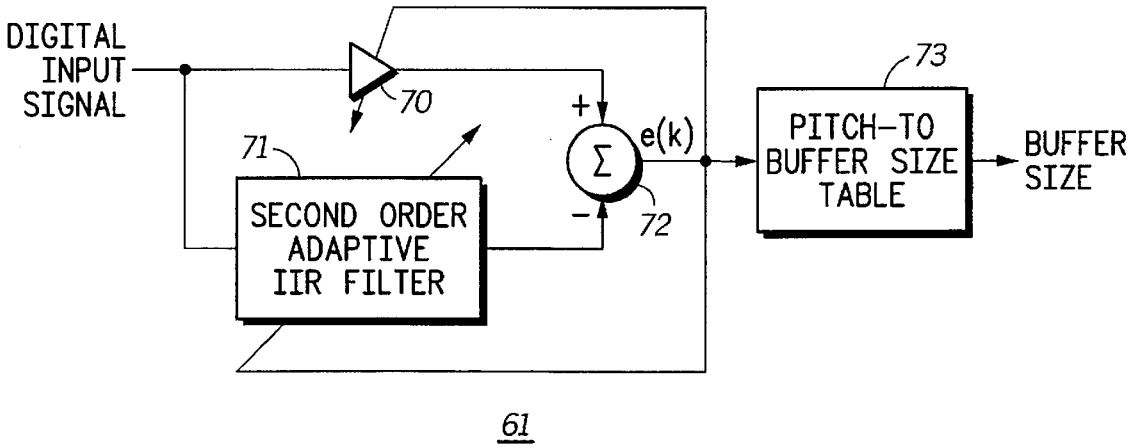
FIG. 6 illustrates in block diagram form the adaptive pitch estimator of FIG. 5.

Adaptive pitch estimator 61 may be any type of structure which estimates the fundamental frequency of DIGITAL INPUT SIGNAL to provide BUFFER SIZE harmonically related thereto. Adaptive pitch estimator 61 may be implemented with hardware circuitry, but is typically implemented by a digital signal processor performing signal processing instructions on DIGITAL INPUT SIGNAL. Preferably, adaptive pitch estimator 61 is implemented as shown in FIG. 6, which illustrates adaptive pitch estimator 61 in block diagram form. Adaptive pitch estimator 61 includes a variable multiplier 70, a second-order adaptive infinite impulse response (IIR) filter 71, a summing device 72, and a pitch-to-buffer size table 73. Filter 71 has a data input for receiving DIGITAL INPUT SIGNAL, a feedback input for receiving a signal labelled "e(k)", and a data output. Multiplier 70 has a multiplier input for receiving DIGITAL INPUT SIGNAL, a multiplicand input for receiving signal e(k), and an output for providing a product thereof. Summing device 72 has a positive input connected to the output of multiplier 70, a negative input connected to the output of filter 71, and an output for providing signal e(k). Table 73 has an input connected to the coefficient output of filter 71, and an output for providing signal BUFFER SIZE.

Filter 71 is a bandpass IIR filter which is continually adapted by the feedback input thereof. Adaptive pitch estimator 61 tries to minimize error signal e(k), which will reach its minimum when the coefficients of filter 71 are centered around the fundamental frequency thereof. Multiplier 70 is also adapted to account for any attenuation caused by filter 71. Table 73 then receives signal e(k) and provides BUFFER SIZE to equal an integral number of periods of the fundamental frequency at the given sample frequency.

Returning now to FIG. 5, variable-size buffer 62 is a buffer of arbitrary length which is large enough to include at least one cycle of DIGITAL INPUT SIGNAL at the highest expected fundamental frequency. As implemented in a conventional digital signal processing system, variable-size buffer 62 is implemented with successive locations of random access memory (RAM). The starting address of buffer 62 is a fixed location in memory, but the ending address varies according to BUFFER SIZE. In the illustrated embodiment, buffer 62 varies from a minimum of 128 16-bit data words to a maximum of 2048 16-bit data words.

Interpolator 63 receives m-bit data words from variable-size buffer 62 and performs interpolation conversion thereon to provide a pitch-shifted DIGITAL OUTPUT SIGNAL at a rate of $f_S$. Again interpolator 63 may be hardware circuitry, but is typically implemented by a digital signal processor performing signal processing instructions on DIGITAL INPUT SIGNAL. Preferably, interpolator 63 is implemented by using a finite impulse response (FIR) filter with a time-varying coefficient matrix, as disclosed by Sangil Park, "Digital Sample-Rate Converters", *SAE Technical Paper Series, International Congress and Exposition,* 1991. Each of the coefficient banks implements a sinx/x response modified by a Blackman-Harris window. The number of coefficients for each filter in interpolator 63 changes adaptively and is equal to BUFFER SIZE.

Figure 7:
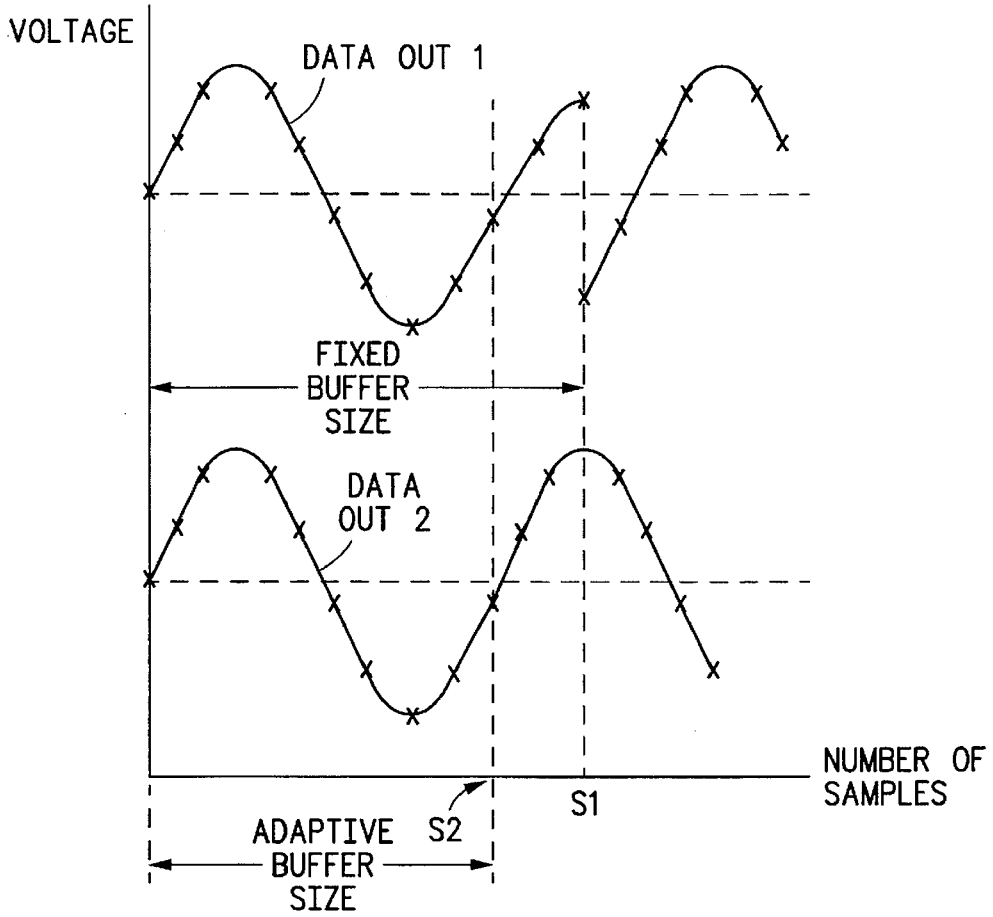
FIG. 7 illustrates a timing diagram of a digital signal illustrating the advantages of the signal processing system of FIG. 5.

Pitch shifter 60 reduces distortion of DIGITAL OUTPUT SIGNAL by preventing the discontinuities caused by having a buffer size not matched to the fundamental frequency. Thus, the optimal buffer size assures the minimum amount of distortion encountered during pitch shifting. This improvement is illustrated diagrammatically in FIG. 7, which illustrates a timing diagram of a digital signal illustrating the advantages of signal processing system 50 of FIG. 5. FIG. 7 illustrates a first waveform labelled "DATA OUT 1" which is produced by the sample rate conversion technique illustrated with respect to FIGS. 3 and 4. At sample point S1, a discontinuity occurs caused by the INPUT POINTER overrunning the OUTPUT POINTER. At S1, a number of samples equal to the FIXED BUFFER SIZE has elapsed. By contrast, in a waveform labelled "DATA OUT 2" which signal processing system 50 provides as an output, signal BUFFER SIZE causes the buffer size to be reduced to a size labelled "ADAPTIVE BUFFER SIZE". ADAPTIVE BUFFER SIZE matches the period of the fundamental frequency of the data input signal. Thus, one complete waveform is stored in the variable-size buffer, and no (or only a small) discontinuity occurs at S2.

Figure 8:
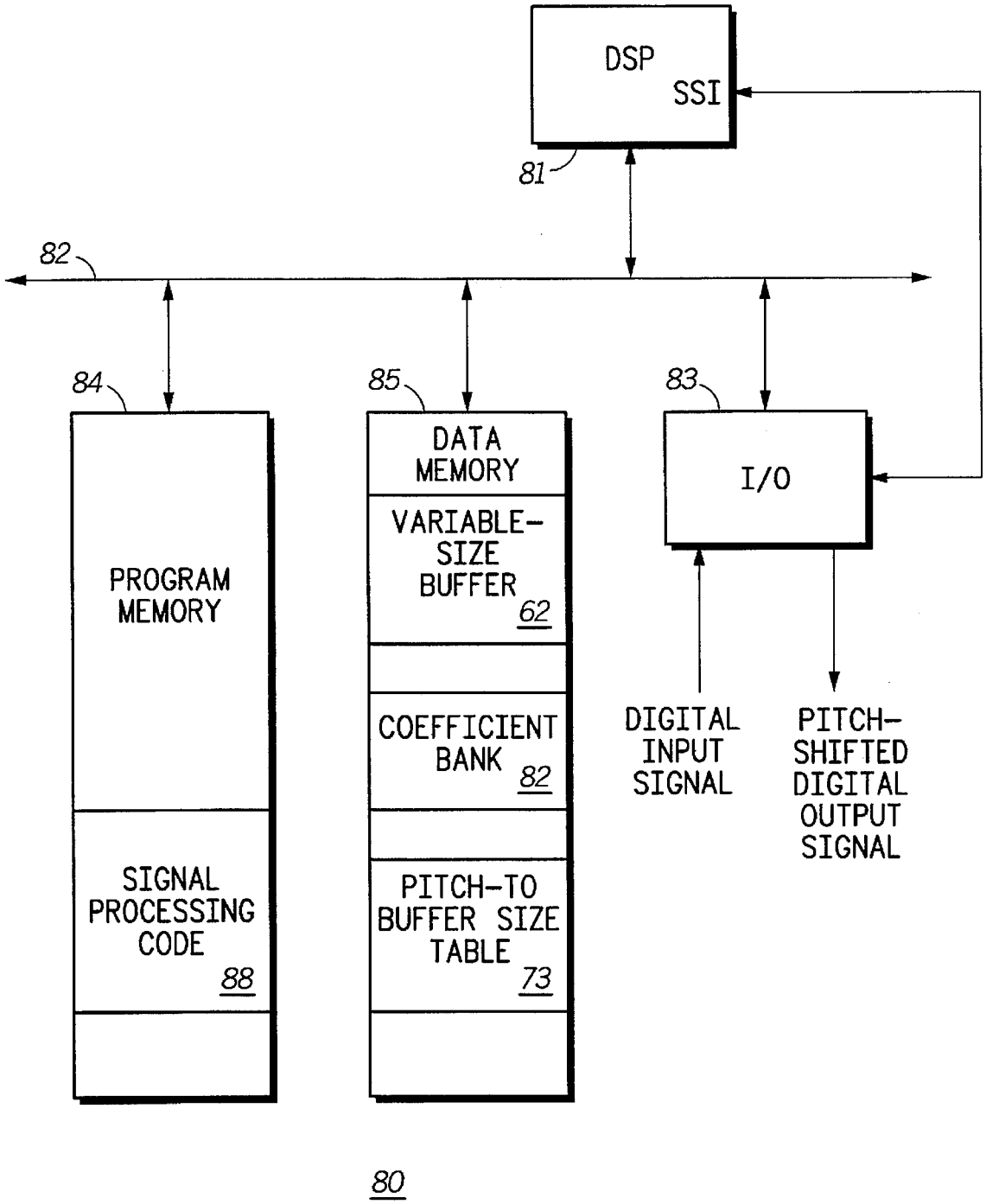
FIG. 8 illustrates in block diagram form a digital signal processing system for implementing the signal processing system of FIG. 5.

As previously indicated, the functions of pitch shifter 60 may be implemented in hardware circuitry, with a digital signal processor running instructions to implement the required signal processing functions, or some combination thereof. By way of example, FIG. 8 illustrates in block diagram form a digital signal processing system 80 for implementing signal processing system 50 of FIG. 5. However, it should be apparent that other signal processing configurations are possible, and the choice of signal processing functions will vary according to the application.

Signal processing system 80 includes a digital signal processor (DSP) 81, a system bus 82, an input/output (I/O) block 83, a program memory 84, and a data memory 85. DSP 81 is a general-purpose DSP with modulo addressing capabilities for efficient implementation of IIR filter 71 of FIG. 6 and the FIR filter of interpolator 63 of FIG. 5, such as the DSP56001 digital signal processor from Motorola, Inc. DSP 81 provides address, control, and data signals to and from I/O block 83, memories 84 and 85 via system bus 82. DSP 81 has an interrupt input for receiving an interrupt signal through an input signal line labelled "SSI" from I/O block 83. I/O block 83 has an input for receiving DIGITAL INPUT SIGNAL, and an output for providing the PITCH SHIFTED DIGITAL OUTPUT SIGNAL. Alternatively, I/O operations could be performed through an ADC and DAC for processing analog signals. I/O block 83 generates interrupts once for every period of $f_S$ to filter the various signals related to the pitch shifting performed herein. DSP 81 programs I/O block 83 via system bus 82 according to the particular values of $f_S$ used in the given application. If required, I/O block 83 may convert different types of data format, such as the Audio Engineering Society/European Broadcaster's Union (AES/EBU) format, to the conventional pulse code modulation (PCM) format, so that the data can be input to DSP 81 in the correct or expected format.

Memory 84 is a non-volatile memory which stores instructions for execution by DSP 81 to perform the pitch shifting and other signal processing functions. For this purpose, memory 84 includes an area 88 labelled "SIGNAL PROCESSING CODE" to cause DSP 81 to implement the signal processing functions illustrated in FIGS. 5 and 6. The instructions in DSP56001 assembly language are listed in APPENDIX A.

Memory 85 is a random access memory (RAM) which includes memory locations which may be used to store parameters, filter coefficients, etc. Three areas of particular interest to pitch shifting are illustrated. A first area implements variable-size buffer 62 of FIG. 5, and is thus assigned the same reference number. Buffer 62 includes consecutive address locations for the maximum buffer size, i.e. 2048 16-bit words in the illustrated embodiment. Buffer 62 is adaptively sized by changing the ending address, i.e. the address at which the buffer pointer "wraps". In terms of DSP 81, the modulus of buffer 62 is adaptively changed so that the wrapping occurs automatically and invisibly to SIGNAL PROCESSING CODE 88. Another area, labelled "COEFFICIENT BANK" 89, includes a bank of coefficients for use by interpolator 63 of FIG. 4. A third area includes pitch-to-buffer size table 73 and is so labelled in FIG. 8. It should be apparent that in other embodiments coefficient bank 89 and pitch-to-buffer size table 73 may be located in nonvolatile memory 84.

While the invention has been described in the context of a preferred embodiment, it will be apparent to those skilled in the art that the present invention may be modified in numerous ways and may assume many embodiments other than that specifically set out and described above. For example, other adaptive pitch estimators besides the one illustrated in FIG. 5 and other interpolators besides the one described herein may be used. Also, signal processing system 50 may be implemented with different DSP systems or different combinations of hardware and software. Accordingly, it is intended by the appended claims to cover all modifications of the invention which fall within the true spirit and scope of the invention.

APPENDIX A

```
;*******************************************************
;       Adaptive Pitch Estimation Subroutine
;*******************************************************
pitch   movep           x:input,a
        move            a1,x:(r3)+                      ;Save Xk to mem and point Xk-1
        move            x:(r3)+,x1 y:(r7)+n7,y1         ;Get Xk-1 to X1, point Xk-2
                                                        ;move Wk/2 into y1, point Ratio
        mpy             x1,y1,a                         ;A = (Wk/2)*Xk-1
                                                        ;move X'k-1 into B and point to
                                                        ;X'k-2
        move            a,x0                            ;X0 = (Wk/2)*Xk-1
        move            y:(r7)+,y0                      ;move Ratio into y0, point -
                                                        ;(1-r**2)/2
        mpy             x0,y0,a y:(r5)+,x0              ;make Ratio*Wk/2*Xk-1,X0=X'k-
                                                        ;1,point X'k-2
        move            y:(r5),y0                       ;move X'k-2 into y0
        mac             x0,y1,a x:(r3)+,x0 y:(r7)+,y1   ;mac X'k-1*Wk/2 & Ratio*Xk
                                                        ;1*Wk/2
                                                        ;move Xk-2 to x0, point Xk
                                                        ;make Y1=-(1-r**2)/2, point
                                                        ;-(r**2)/2
        mac x0,y1,a     y:(r7)+,x0                      ;Mac -.19*Xk-1, x0=-.81 and point to
                                                        ;Ek
        move            (r7)+n7                         ;point to Dk
        mac x0,y0,a     y:(r7)-n7,y0                    ;Mac -(r**2)/2*X"k-2, Dk=y0,point
                                                        ;Ek
        asl a           x:(r3)+,x1                      ;correct to make X'k, get Xk, point
                                                        ;Xk-1
        move            a,y:(r5)-                       ;save X'k to memory, overwriting
        mpy             x1,y0,b                         ;multiply Dk*Xk = Yk
        sub             a,b                             ;subtract Dk*Xk-X'k = Ek
        move            b,y:(r7)+                       ;save Ek & point Wk
        move            x:(r3)+,x1                      ;move Xk-1 into x1,point Xk-2 for
                                                        ;update
        move            #ratio,y0                       ;put (1-r**2)/(1+r*2) into y0
        mpy x1,y0,a     y:(r5)+,y0                      ;Mpy #ao2*Xk-1 to A, move X'k-1
                                                        ;into y0
        add y0,a        #mu1,x1                         ;Make Ak=#ao2*Xk-1 + X'k-1,
                                                        ;make x1=u1
        asr             a                               ;divide Ak by two to prevent
                                                        ;overflow
        and             #$bf,ccr                        ;clear limit bit to check overflow
        move            a,y0                            ;move Ak into y0
        mpy x1,y0,a     b,x0                            ;multiply (Ak/2)*u1, x0=Ek
        move            a,x1                            ;move Ak*mu=x1
        mpy x0,x1,a     y:(r7)+,x0                      ;Mac Ak*mu*Ek, move Wk/2 to
                                                        ;x0, point dk
        move            #$7fffff,y0                     ;y0=1. to make Dk=1
        add x0,a        y0,y:(r7)-                      ;Find Wk+1 and save 1 to Dk+1,
                                                        ;point Wk
        and             #$bf,ccr                        ;clear limit bit
        move            a,y:(r7)                        ;save Wk+1 and no pointer change
        move            (r3)+                           ;point to Xk
        move            x:(r3)-,b y:(r5),y0             ;move Xk into b and
                                                        ;move X'k into y0
        move            y:dk,y1                         ;move Dk into y1
        mpy y0,y1,a     #mu2,x0                         ;Multuply X'k*Dk, move mu2 into
                                                        ;x0
        sub             a,b
        move            b,x1                            ;Xk - X'k*Dk
        move            y:(r5),x1                       ;move Xk into x1
        mpy x1,x0,a     b,y:err2                        ;Xk*mu2, move error term into
                                                        ;memory
        move            a,x1
        move            b,y1                            ;move error and Xk*mu2 into
```

-continued

APPENDIX A

```
                                                    ;registers
        mpy x1,y1,a         y:dk,y0                 ;Xk*mu2*err2
        add y0,a                                    ;DK+1 = Dk + Xk*mu2*err2
        move                a,y:dk                  ;Store Dk+1
        movep               a,x:output
        rts
;*************************************************
;       Interpolation Main Routine
;*************************************************
inter   clr                 a                       ;you'll need this soon . . .
        movep               a,X:M_BCR               ;BCR = 0, no wait states
        movec               a,sp                    ;init stack pointer
        movec               a,sr                    ;clear loop flag
        move                a,X:M_PCC               ;zero PCC to cycle it, reset SSI
        movep               #$4104,X:M_CRA          ;16-bit words,2 words/frame,
                                                    ;SSI Clk=osc/4/(4+1)=osc/20
        movep               #$F1B0,X:M_CRB          ;Tx/Rx enabled, both Ints. enabled
                                                    ;normal,cont.clk,async,Rx,FS(bit)
                                                    ;Tx,FS(word),MSB out 1st,int clk
        movep               #$01FF,X:M_PCC          ;enable all SSI & SCI functions
;*****************************************
; Initialize all pointers *
;*****************************************
        move                #InBuffer,r0            ;r0 points to input data
        move                #InBuffLen-1,m0         ;InBuff is a circular buffer
        move                m0,m1                   ;filter ptr needs same modulus
        bset #1,r7                                  ;flag set = nothing to do . . .
        movep               #$3000,X:M_IPR          ;set SSI Interrupt Priority Level
        andi    #$FC,MR                             ;unmask all interrupt levels
loop    jset    #1,r7,*                             ;now, loop waiting for data . . .
;*******************************************************
;* Interpolate Next SSI_Tx Sample *
;*******************************************************
SSI_TX
        movep               Y:RD_CNTR,x0            ;x0 = delay in ticks from ext. cntr
        move                #K_PTR,y0               ;y0 = mpy constant to adjust ptr.
        mpyr x0,y0,a r0,r1                          ;compute ptr to filter coeff.s
                                                    ;r0 may change . . . r1 = input ptr
        move                a1,r4                   ;r4 will point into coeff. table
        bset                #1,r7                   ;set flag for new sample needed
;*************************************
;* APPLY FILTER *
;*************************************
        clr     b           X:(r1)+,X0 Y:(r4)+,Y0   ;get data, coeff, init B
        rep     m0
        mac     x0,y0,b     X:(r1)+,X0 Y:(r4)+,Y0   ;apply filter
        macr x0,y0,b                                ;leave next output in "B"
        jmp     loop
        end
```

We claim:

1. A signal processing system for performing real-time pitch shifting, comprising:

an adaptive pitch estimator having an input terminal for receiving a digital input signal, a sampling rate input terminal for receiving a sample clock signal, and an output terminal for providing a buffer size signal, said adaptive pitch estimator providing said buffer size signal to equal an integer multiple of, a period of a fundamental frequency component of said digital input signal divided by a period of said sample clock signal;

a variable-size buffer having a data input terminal for receiving said digital input signal, a size input terminal coupled to said output terminal of said adaptive pitch estimator for receiving said buffer size signal, and an output terminal; and an interpolator having a data input terminal coupled to said output terminal of said variable-size buffer, and an output terminal for providing a pitch-shifted digital output signal.

2. The signal processing system of claim 1 further comprising an analog-to-digital converter (ADC) having an input for receiving an analog input signal, a clock input terminal for receiving said sample clock signal, and an output terminal for providing said digital input signal.

3. The signal processing system of claim 1 further comprising a digital-to-analog converter (DAC) having an input terminal coupled to said output terminal of said interpolator, a clock input terminal for receiving said sample clock signal, and an output terminal for providing a pitch-shifted analog output signal.

4. The signal processing system of claim 1 wherein said adaptive pitch estimator comprises:

a variable multiplier having a multiplier terminal for receiving said digital input signal, a multiplicand terminal for receiving an error signal, and an output terminal;

an adaptive infinite impulse response (IIR) filter having a data input terminal for receiving said digital input signal, a feedback input terminal for receiving said error signal, and an output terminal;

a summing device having a positive input terminal coupled to said output terminal of said variable multiplier, a negative input terminal coupled to said output terminal of said adaptive IIR filter, and an output terminal for providing said error signal; and conversion means coupled to said summing device, for providing said buffer size signal in response to said error signal.

5. The signal processing system of claim 1 wherein said variable-size buffer comprises:

a predetermined number of locations of a memory, a number of active ones of said predetermined number of locations of said memory corresponding to said buffer size signal; and storage means coupled to said predetermined number of locations of said memory, for sequentially storing said digital input signal from a starting address of said predetermined number of locations of said memory to an ending address offset from said starting address by said buffer size signal, synchronously with said sample clock signal.

6. The signal processing system of claim 5 wherein said storage means comprises a digital signal processor (DSP) with modulo addressing capability.

7. The signal processing system of claim 1 wherein said interpolator further has a sampling rate input terminal for receiving a variable pitch-shifting ratio.

8. A signal processing system for performing real-time pitch shifting, comprising:

an adaptive pitch estimator having an input for receiving a digital input signal, and an output for providing a buffer size signal corresponding to a fundamental frequency of said digital input signal;

a variable-size buffer having a data input for receiving said digital input signal, a size input for receiving said buffer size signal, and an output; and interpolation means coupled to said output of said variable-size buffer, for converting samples from said variable-size buffer from a first pitch to a second pitch according to a pitch-shifting ratio, and for providing a pitch-shifted digital output signal in response thereto.

9. The signal processing system of claim 8 further comprising input conversion means for sampling an analog input signal and for providing said digital input signal in response thereto.

10. The signal processing system of claim 9 wherein said input conversion means comprises a sigma-delta analog-to-digital converter (ADC).

11. The signal processing system of claim 8 further comprising output conversion means coupled to said interpolation means, for providing a pitch-shifted analog output signal in response to said pitch-shifted digital output signal.

12. The signal processing system of claim 11 wherein said output conversion means comprises a sigma-delta digital-to-analog converter (DAC).

13. The signal processing system of claim 8 wherein said adaptive pitch estimator comprises:

a variable multiplier having a multiplier terminal for receiving said digital input signal, a multiplicand terminal for receiving an error signal, and an output terminal;

an adaptive infinite impulse response (IIR) filter having a data input terminal for receiving said digital input signal, a feedback input terminal for receiving said error signal, and an output terminal;

a summing device having a positive input terminal coupled to said output terminal of said variable multiplier, a negative input terminal coupled to said output terminal of said adaptive IIR filter, and an output terminal for providing said error signal; and conversion means coupled to said summing device, for providing said buffer size signal in response to said error signal.

14. A method for performing real-time pitch shifting comprising the steps of:

receiving a digital input signal at a sample dock rate;

storing said digital input signal at successive locations of a variable-size buffer having a variable size associated therewith;

adaptively estimating a fundamental frequency of said digital input signal to provide an estimated fundamental frequency;

changing said variable size of said variable-size buffer in response to said estimated fundamental frequency; and interpolating said digital input signal stored in said variable-size buffer to provide a digital pitch-shifted output signal.

15. The method of claim 14 wherein said step of changing comprises the step of changing said variable size of said variable-size buffer to store said digital input signal for an integral number of periods of said estimated fundamental frequency.

16. The method of claim 14 wherein said step of interpolating comprises the step of interpolating said digital input signal stored in said variable-size buffer to provide a digital pitch-shifted output signal according to a variable pitch-shifting ratio.

* * * * *